United States Patent [19]

Shimonosono

[11] Patent Number: 4,664,072

[45] Date of Patent: May 12, 1987

[54] COOLING SYSTEM FOR AUTOMOTIVE ENGINE OR THE LIKE

[75] Inventor: Hitoshi Shimonosono, Yokosuka, Japan

[73] Assignee: Nissan Motor Co., Ltd., Yokohama, Japan

[21] Appl. No.: 866,259

[22] Filed: May 23, 1986

[30] Foreign Application Priority Data

Jun. 3, 1985 [JP] Japan ..... 60-82466[U]

[51] Int. Cl.[4] ..... F01P 3/22

[52] U.S. Cl. ..... 123/41.21; 123/41.25

[58] Field of Search ..... 123/41.2–41.27

[56] References Cited

U.S. PATENT DOCUMENTS

| | | | |
|---|---|---|---|
| 1,731,016 | 10/1929 | Lehman | 123/41.2 |
| 2,443,518 | 6/1948 | Rushmore | 123/41.23 |
| 4,499,866 | 2/1985 | Hirano | 123/41.21 |
| 4,570,579 | 2/1986 | Hirano | 123/41.21 |
| 4,590,893 | 5/1986 | Hirano | 123/41.27 |

FOREIGN PATENT DOCUMENTS 775800 5/1957 United Kingdom .

*Primary Examiner*—William A. Cuchlinski, Jr.

*Attorney, Agent, or Firm*—Schwartz, Jeffery, Schwaab, Mack, Blumenthal & Evans

[57] ABSTRACT

In order to attenuate the amount of liquid coolant which flows from the coolant jacket to the radiator of an evaporative cooled internal combustion engine, a vapor manifold is arranged to induce the coolant vapor to flow through a collector section thereof in a manner that the liquid droplets develop a velocity which tends to carry the same through a drain port formed at one end of the manifold. The vapor is caused to pass out through a vapor discharge port formed at an acute angle with respect to the direction in which the coolant flows through the collector section. This induces a flow pattern in the vapor flow which produces an angular acceleration which separates liquid coolant droplets from the vapor before the vapor passes out through the vapor discharge port.

5 Claims, 11 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to a simple and compact vapor manifold for such a system which attenuates excessive transmission of liquid coolant along with the coolant vapor between the engine coolant jacket and the radiator or condensor in which the coolant is condensed back to its liquid form.

2. Description of the Prior Art

In currently used "water cooled" internal combustion engines (liquid) is forcefully circulated by a water pump, through a cooling circuit including the engine coolant jacket and an air-cooled radiator. This type of system encounters the drawback that a large volume of water is required to be circulated between the radiator and the coolant jacket in order to remove the required amount of heat.

Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min (viz., $4000-60\times14$) must be produced by the water pump. This of course undesirably consumes several horsepower.

FIG. 2 shows an arrangement disclosed in Japanese Patent Application Second Provisional Publication Sho. No. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arrangement, has suffered from the drawbacks that the radiator, depending on its position with respect to the engine proper, tends to be at least partially filled with liquid coolant. This greatly reduces the dry surface area via which the gaseous coolant (for example steam) can effectively release its latent heat of vaporization and accordingly condense, and thus has lacked any notable improvement in cooling efficiency. Further, with this system in order to maintain the pressure within the coolant jacket and radiator at atmospheric level, a gas permeable water shedding filter 5 is arranged as shown, to permit the entry of air into and out of the system.

However, this filter permits gaseous coolant to readily escape from the system, inducing the need for frequent topping up of the coolant level. A further problem with this arrangement has come in that some of the air, which is sucked into the cooling system as the engine cools, tends to dissolve in the water, whereby upon start up of the engine, the dissolved air tends to come out of solution and forms small bubbles in the radiator which adhere to the walls thereof and form an insulating layer. The undissolved air also tends to collect in the upper section of the radiator and inhibit the convention-like circulation of the vapor from the cylinder block to the radiator. This of course further deteriorates the performance of the device.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down, the coolant vapor condenses and induces sub-atmospheric conditions which tend to induce air to leak into the system. This air tends to be forced by the compressor along with the gaseous coolant into the radiator.

Due to the difference in specific gravity, the above mentioned air tends to rise in the hot environment while the coolant which has condensed moves downwardly. The air, due to this inherent tendency to rise, tends to form pockets of air which cause a kind of "embolism" in the radiator and which badly impair the heat exchange ability thereof.

With this arrangement the provision of the compressor renders the control of the pressure prevailing in the cooling circuit for the purpose of varying the coolant boilding point with load and/or engine speed difficult.

U.S. Pat. No. 4,367,699 issued on Jan. 11, 1983 in the name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservior-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

The rate of condensation in the condensor is controlled by a temperature sensor disposed on or in the condensor per se.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes toward and into the coolant jacket, inhibits the penetration of fresh liquid coolant into the layers and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows in arrangement which is disclosed in U.S. Pat. No. 4,549,505 issued on Oct. 29, 1985 in the name of Hirano. The disclosure of this application is hereby incorporated by reference thereto. For convenience the same numerals as used in the above mentioned Patent are also used in FIG. 7.

This arrangement while solving the drawbacks encountered with the previously disclosed prior art has itself suffered from the drawbacks that when the engine is operated under high speed/load conditions, the boiling of the coolant in the coolant jacket 120 becomes so vigorous as to bump and froth to the degree that sufficient liquid coolant flows from the coolant jacket to the radiator 126 as to wet the interior of the latter mentioned device to the point of inhibiting the release of the latent heat of evaporation of the gaseous coolant. Viz., the liquid film on the wetted surfaces of the radiator act as an insulator which prevents the heat in the vapor from being readily released. This situation is highly undesirable in that the engine tends to be combusting large amounts of fuel per unit time at this time (ie. high speed/load operation) and thus induces the demand for a high radiator heat exchange efficiency.

FIGS. 8 and 9 show an arrangement disclosed in U.S. Pat. No. 4,499,866 issued on Feb. 19, 1985 in the name of Hirano which directed to overcomming the "boil-over" type problem discussed hereinabove. This arrangement includes a vapor manifold 232 which is mounted atop of a cylinder head which has a internal passage structure designed to limit the boiling froth which actually enters the manifold per se. The manifold 232 as shown, has a collector section 234 which is located vertically above the vapor discharge ports 216 formed in the cylinder head. With this, any liquid coolant which precipitates out of the vapor flow due to the numerous changes in flow direction which occur before the flow reaches the outlet 238 of the manifold, tends to drain back down into the coolant jacket partially quelling the upwardly moving coolant froth and foam.

However, as shown the overall height of the engine is increased by the provision of this type of manfifold and thus induces design problems when attempting the lower the bonnet line of an automotive vehicle wherein the engine is located in the forward section of the engine.

The content of the above mentioned United States Patent is hereby incorporated by reference thereto. For ease of comparison the numerals used in FIGS. 8 and 9 differ from those used in the corresponding drawings of the said patent only by the addition of the value of 200 to each. Viz., numeral 10 becomes 210 etc.

SUMMARY OF THE INVENTION

It is an object of the present invention to provide a vapor manifold for an evaporative cooled engine which is compact and simple in construction and which suitably attenutes the transmission of coolant in its liquid state between the coolant jacket and the radiator of the system.

In brief, the above object is achieved by a vapor manifold which is arranged to induce the coolant vapor to flow through a collector section thereof in a manner that the liquid droplets develop a velocity which tends to carry the same through a drain port formed at one end of the manifold. The vapor is caused to pass out through a vapor discharge port formed at an acute angle with respect to the direction in which the coolant flows through the collector section. This induces a flow pattern in the vapor flow which produces an angular acceleration which separates liquid coolant droplets from the vapor before the vapor passes out through the vapor discharge port.

More specifically, the present invention takes the form of a cooling system for an internal combustion engine which includes a coolant jacket in which coolant is boiled and a coolant vapor produced; a radiator in fluid communication with the coolant jacket and in which the coolant vapor produced in the coolant jacket is condensed to its liquid form; and a vapor manifold interposed between the coolant jacket and the radiator, the manifold comprising: an elongate collector section which communicates with the coolant jacekt through a runner; means defining a liquid drain port at one end of the collector, the drain port being essentially aligned with a longitudinal axis of the collector section, the collector section being arranged so that the vapor from the branch runner enters the collector section and flows essentially along the longitudinal axis toward the drain port; means defining a vapor discharge port, the vapor discharge port being arranged in proximity of the drain port at a location upsteam of the drain port and at an angle with respect to the longitudinal axis, the vapor discharge port being fluidly communicated with the radiator; the arrangement of the drain port and the vapor discharge port being such as to define means for causing the vapor to be subject to an angular acceleration which causes liquid coolant entrained therein to be separated from the vapor before the vapor passes through the vapor discharge port.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENT

Figure 1:
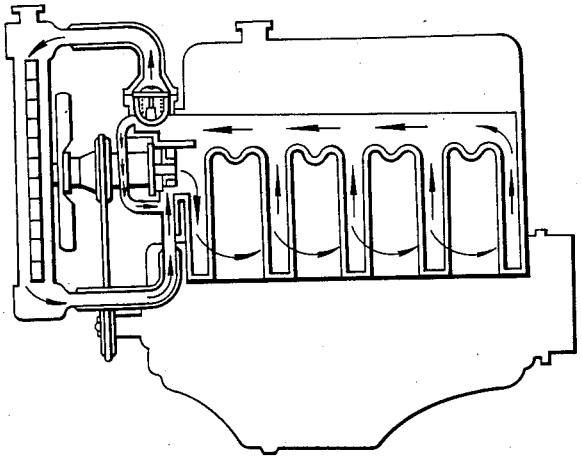
FIG.1 (PRIOR ART)
FIGS. 1 to 4 show the prior art arrangements discussed in the opening paragraphs of the instant disclosure.
Figure 2:
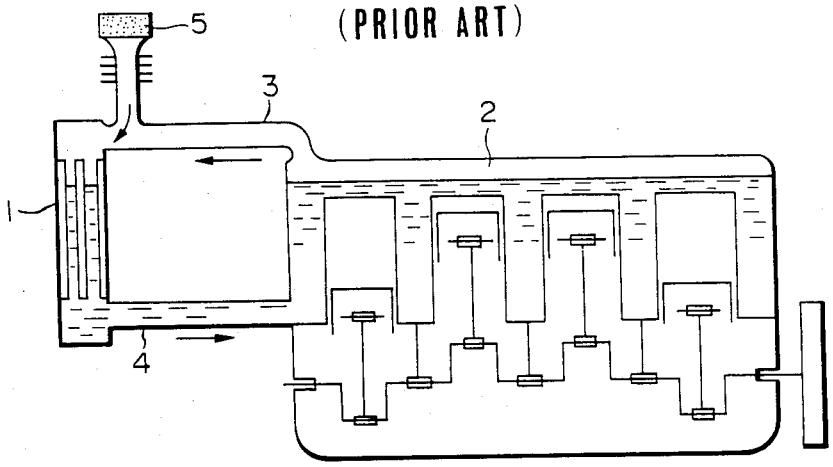
FIG.2 (PRIOR ART)
Figure 3:
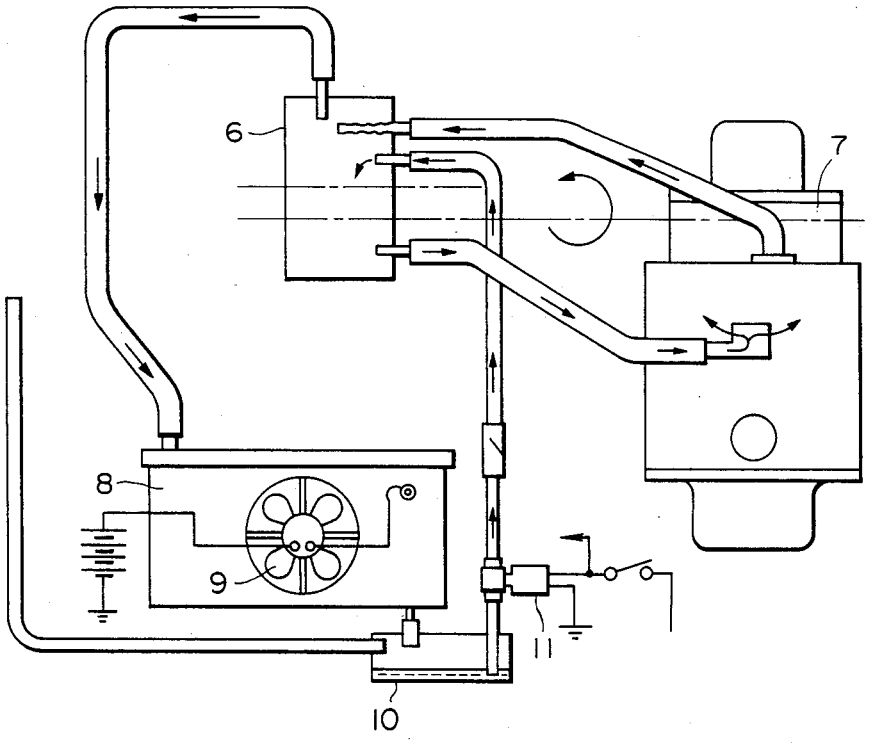
FIG.3 (PRIOR ART)
Figure 4:
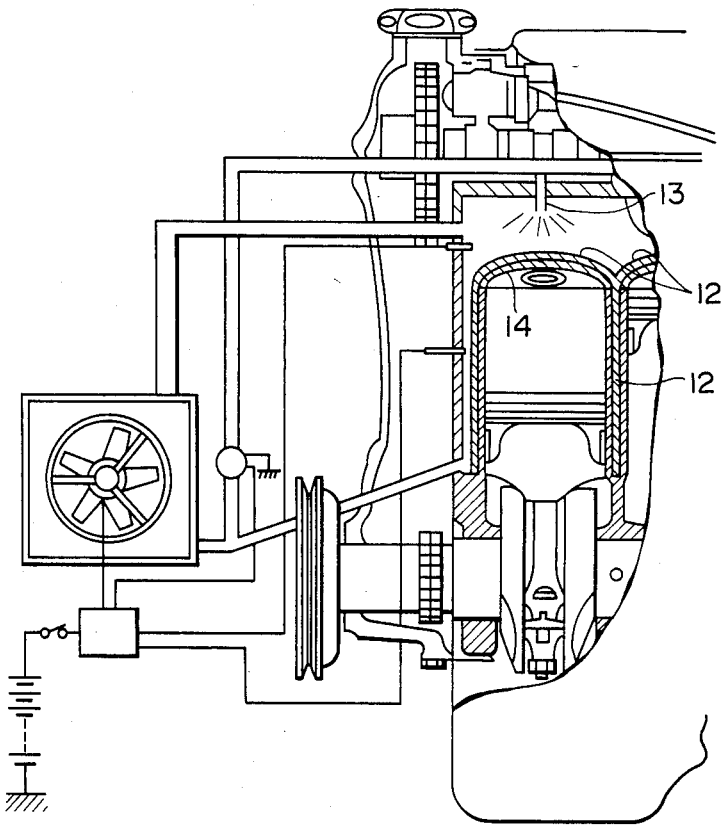
FIG.4 (PRIOR ART)
Figure 5:
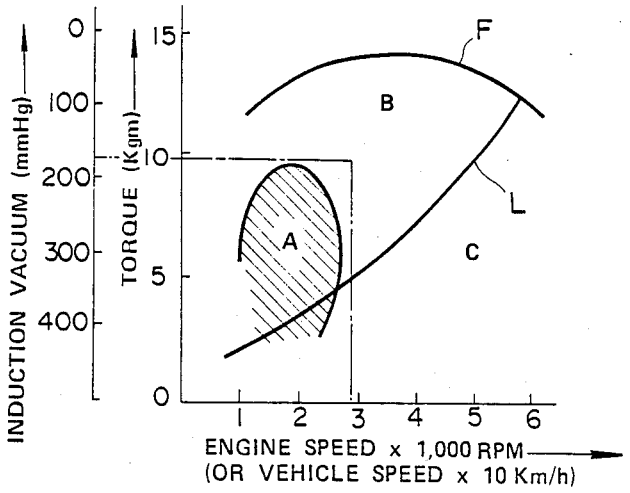
FIG. 5 is a diagram showing in terms of engine load and engine speed the various load zones which are encountered by an automotive internal combustion engine.
Figure 6:
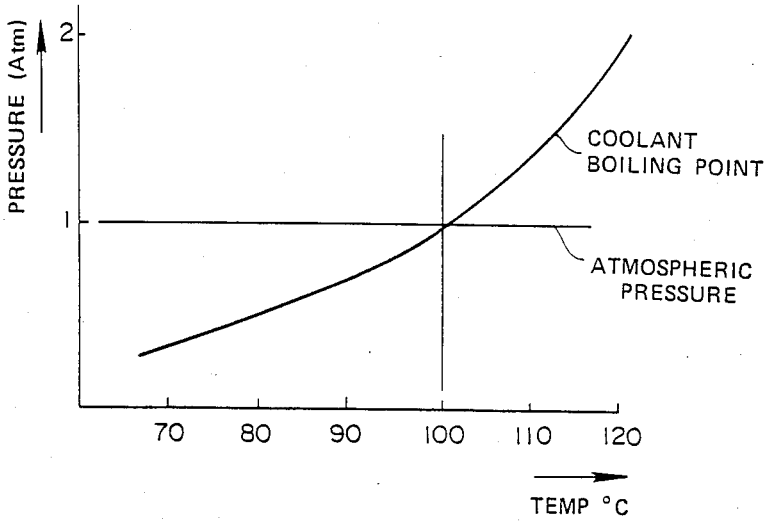
FIG. 6 is a graph showing in terms of pressure and temperature the changes in the coolant boiling point in a closed circuit type evaporative cooling system.
Figure 7:
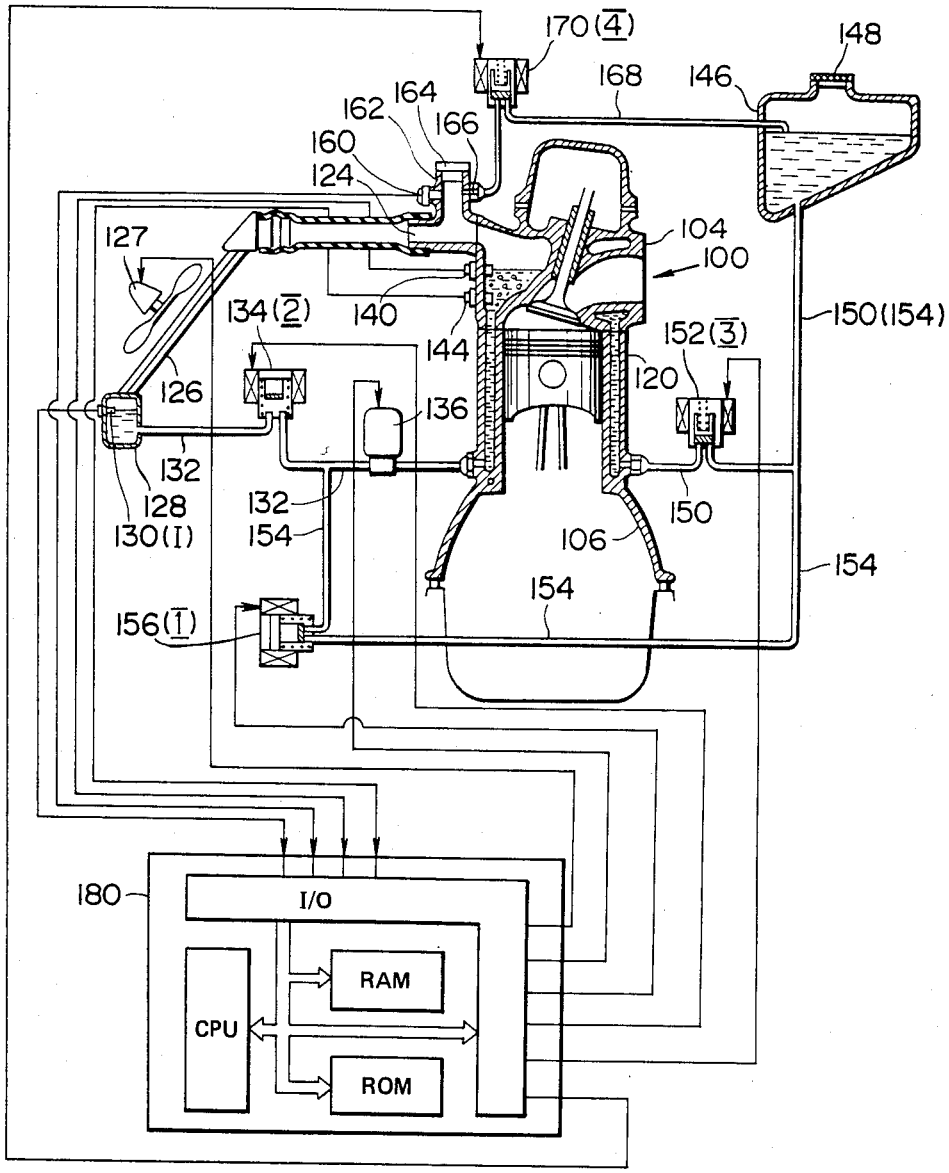
FIG. 7 shows in schematic elevation the arrangement disclosed in the opening paragraphs of the instant disclosure in conjunction with U.S. Pat. No. 4,549,505.
Figure 8:
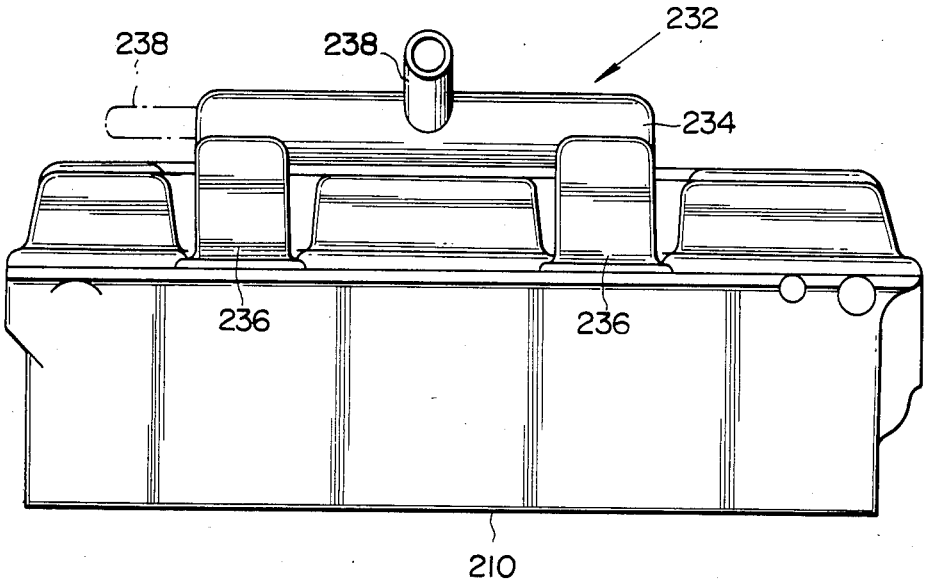
FIGS. 8 and 9 show in side elevation and front section, the arrangement discussed in connection with U.S. Pat. No. 4,499,866.
Figure 9:
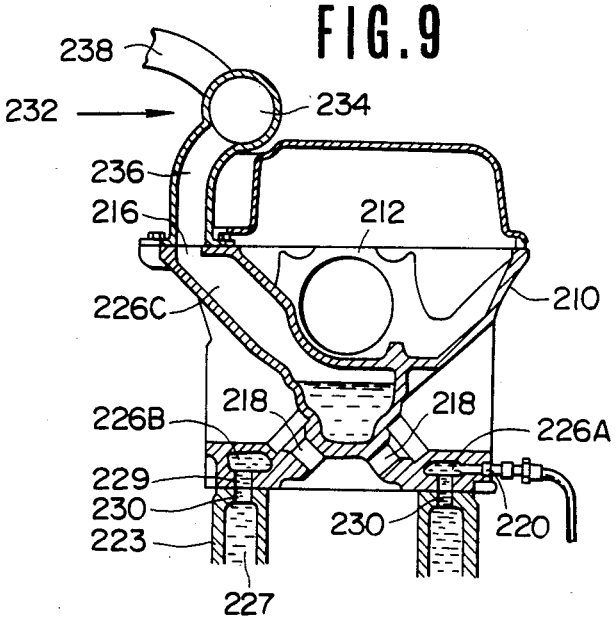
Figure 10:
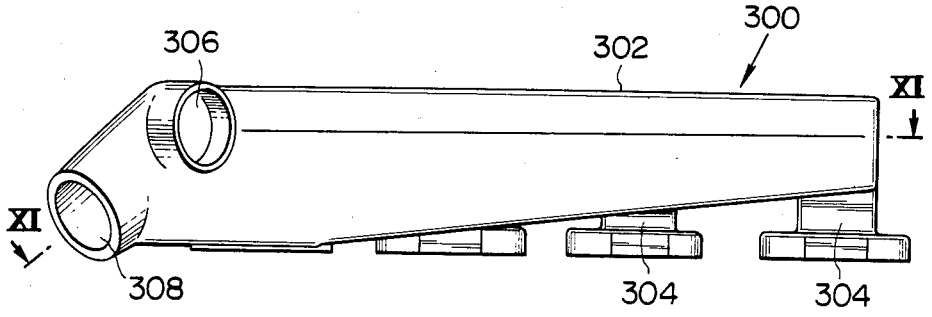
FIGS. 10 and 11 show an embodiment of the present invention.
Figure 11:
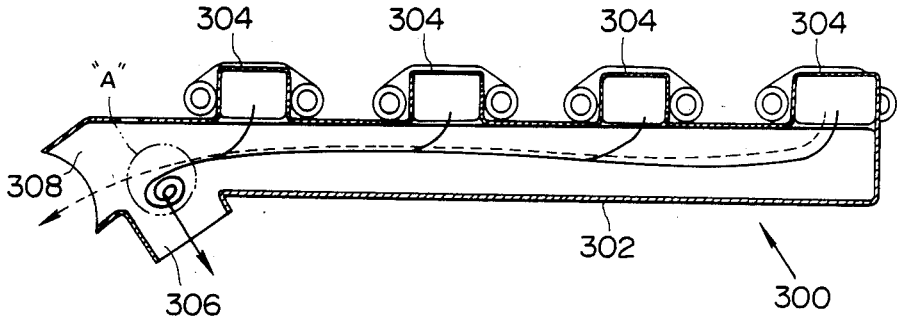

FIGS. 10 and 11 show an embodiment of the present invention. This arrangement as shown, takes the form of a manifold 300 having an enlongate collector section 302 which communicates with a plurality of vapor discharge ports (not shown) via branch runners 304. It will be noted that the cross sectional of the collector section 302 increases in the direction of the vapor discharge port 306 and the liquid coolant drain port 308 so as to accomodate the increased amount of vapor which tends to be introduced into the device with each succesive branch runner 304.

The liquid coolant drain port 308 is located at one end of the manifold in a manner to be essentially alinged with the axis of the arrangement, while the vapor discharge port 306 is arranged to extend from one side of the manifold. In the instant embodiment the vapor discharge port 306 is arranged with respect to the axial direction of the collector section 302 in a manner which defines an acute angle therewith.

With this arrangement as the coolant vapor enters the collector section 302 from the branch runners 304 it tends to flow in a manner which imparts sufficient velocity to the droplets of liquid coolant entrained therein that upon reaching the end of the collector whereat the drain and discharge ports 308, 306 are located the droplets are carried (as shown by broken line) under the influence of their own inertia toward and into the drain port 308 while the vapor (as shown in solid line) undergoes a change in direction which tends to induce a rotating flow pattern. This latter mentioned phenomeon imparts an angular acceleration to the liquid coolant in zone "A" which tends to induce a kind of "centrifugal" separation wherein the remaining droplets of liquid in the vapor flow tend to to "flung off" from the vapor flow and prevented from passing through the vapor discharge port along with the vapor per se.

Although not shown, the drain port 308 can be connected to the coolant jacket in a manner to return the collected coolant thereto. Examples of connections which can be used to return the collected coolant may be found in copending U.S. patent application Ser. No. 654,222 filed on Sept. 25, 1984 in the name of Hirano now U.S. Pat. No. 4,570,579 and Ser. No. 751,537 filed on July 3, 1985 in the name of Hayashi et al.

What is claimed is:

1. In a cooling system for an internal combustion engine a coolant jacket in which coolant is boiled and a coolant vapor produced;

a radiator in fluid communication with said coolant jacket and in which the coolant vapor produced in said coolant jacket is condensed to its liquid form; and a vapor manifold interposed between said coolant jacket and said radiator, said manifold comprising:

an elongate collector section which communicates with said coolant jacket through a runner;

means defining a liquid drain port at one end of said collector, said drain port being essentially aligned with a longitudinal axis of the collector section, said collector section being arranged so that the vapor from said branch runner enters said collector section and flows essentially along said longitudinal axis toward said drain port;

means defining a vapor discharge port, said vapor discharge port being arranged in proximity of said drain port at a location upsteam of said drain port and at an angle with respect to said longitudinal axis, said vapor discharge port being fluidly communicated with said radiator;

the arrangement of said drain port and said vapor discharge port being such as to define means for causing said vapor to be subject to an angular acceleration which causes liquid coolant entrained therein to be separated from the vapor before the vapor passes through the vapor discharge port.

2. A vapor manifold as claimed in claim 1, wherein said collector section communicates with said coolant jacket via a plurality of sequentially arranged runners and wherein the cross-sectional area of the collector section increases in the direction of said liquid drain port so as to accommodate the increased amount of coolant vaor which is introduced with each successive branch runner.

3. A vapor manifold as claimed in claim 2, wherein said liquid drain port is arranged to define an oblique angle with respect to said longitudinal axis and said vapor discharge port is arranged at an acute angle with respect to said longitudinal axis.

4. A vapor manifold as claimed in claim 3, wherein said vapor discharge port is arranged at a level which is higher than the level at which said liquid drain port is arranged.

5. A vapor manifold as claimed in claim 4, wherein said collector section causes the flow of vapor therein to assume velocity which is directed toward said liquid drain port and wherein said vapor discharge port and said liquid discharge port are arranged in a manner which causes a change in flow direction of the vapor flowing through the collector section which induces a rotating flow pattern upstream of said vapor discharge port, said spiralling flow pattern imparting said angular acceleration to the liquid coolant in said flow which causes said liquid coolant to separate from the vapor upstream of vapor discharge port.

* * * * *